US007741788B2

(12) United States Patent
Ito et al.

(10) Patent No.: US 7,741,788 B2
(45) Date of Patent: Jun. 22, 2010

(54) LIGHT EMITTING APPARATUS WITH CURRENT LIMITING

(75) Inventors: Masayasu Ito, Shizuoka (JP); Takayoshi Kitagawa, Shizuoka (JP); Kentarou Murakami, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 12/031,935

(22) Filed: Feb. 15, 2008

(65) Prior Publication Data

US 2008/0203946 A1 Aug. 28, 2008

(30) Foreign Application Priority Data

Feb. 22, 2007 (JP) ..... 2007-042052

(51) Int. Cl.
*H05B 41/16* (2006.01)

(52) U.S. Cl. ..... 315/247; 315/291; 315/307; 315/312; 315/185 S

(58) Field of Classification Search ..... 315/247, 315/246, 225, 224, 291, 307, 312, 185 S
See application file for complete search history.

(56) References Cited

U.S. PATENT DOCUMENTS 5,808,440 A * 9/1998 Bennett et al. ..... 318/778
6,636,003 B2 * 10/2003 Rahm et al. ..... 315/179
6,858,994 B2 * 2/2005 Vollrath ..... 315/200 A
6,864,641 B2 * 3/2005 Dygert ..... 315/216
7,205,727 B2 * 4/2007 Takeshita et al. ..... 315/291
7,425,943 B2 * 9/2008 Furukawa ..... 345/102
2007/0262796 A1 * 11/2007 Murakami ..... 327/109
2008/0018261 A1 * 1/2008 Kastner ..... 315/192
2008/0191642 A1 * 8/2008 Slot et al. ..... 315/295

FOREIGN PATENT DOCUMENTS

JP 2001-215913 8/2001
JP 2006-86063 3/2006

* cited by examiner

*Primary Examiner*—Tuyet Vo
(74) *Attorney, Agent, or Firm*—Fish & Richardson P.C.

(57) ABSTRACT

In conduction of light emitting diodes LEDs 1 to 4, a switching signal 101 is converted into a voltage V2 or 0V through a signal converter 26 in accordance with a logic level thereof. The voltage obtained by the conversion is compared with a voltage V1 on both ends of a resistor R1 through an operational amplifier 20 to open/close an output loop by an NMOS transistor 22, a current If of the light emitting diodes LEDs 1 to 4 is limited to a current If1 so as not to exceed a maximum current, and a current defined with an ON duty of the switching signal 101 is caused to flow as a mean current to the light emitting diodes LEDs 1 to 4 to inhibit an overshoot current from flowing to the light emitting diodes LEDs 1 to 4 while the output loop is closed.

8 Claims, 6 Drawing Sheets

LIGHT EMITTING APPARATUS WITH CURRENT LIMITING

The present application claims priority from Japanese Patent Application No. 2007-042052 filed on Feb. 22, 2007. The entire disclosure of that application is incorporated herein by reference.

TECHNICAL FIELD

The present disclosure relates to a light emitting apparatus and, more particularly, to a light emitting apparatus arranged to be used as a lighting device for a vehicle.

BACKGROUND

Conventionally, a vehicle lighting device includes a semiconductor light emitting device such as an LED (Light Emitting Diode) used as a light source. In an ON operation of the LED, for example, a battery voltage is chopped and raised by using a DC/DC converter as a power supply. The raised voltage is rectified and smoothed, and the smoothed DC power is supplied to the LED. In this case, a shunt resistor is inserted together with the LED in an output loop of the DC/DC converter, a current of the LED is detected from a voltage on both ends of the shunt resistor, and feedback control is carried out so that the current flowing to the LED is constant in the DC/DC converter based on the detected current. In the case in which multiple LEDs are connected to each other in series, each of the LEDs can be turned ON to generate the same amount of light even if a forward voltage Vf of the LED varies when the feedback control is performed so that the current flowing to the LED is constant.

On the other hand, in some cases when the LED is used as a light source, the LED is such that the current is greatly changed even if the supply voltage is varied slightly and a ripple component is superposed on the current flowing to the LED in the same manner as in a rectifying diode. For this reason, a smoothing capacitor having a large capacitance is used in the DC/DC converter to suppress the ripple of the current.

Moreover, it is possible to control the ON operation of the LED using the DC/DC converter by reducing a current ("If") to be fed back, corresponding to the amount of a so-called extinction, when decreasing the amount of light emitted from the LED to carry out the extinction, for example. When changing the current to be fed back, corresponding to the amount of extinction, however, there is sometimes a problem in that a color shift is generated when the extinction is carried out to have a small light quantity of 10% with respect to a light quantity of 100% (a light quantity in a full ON operation obtained when a rated current is caused to flow to the LED), for example. More specifically, in an LED which emits white light through the supply of the rated current in the full ON operation, in some cases, when the current to be supplied to the LED is reduced in the extinction ON operation, a blue component in a luminescent color of the LED gradually is reduced and the LED emits a greenish color light.

Therefore, a method has been proposed in which a power circuit including a switching regulator. The method includes repeating control for supplying a rated current from the power circuit to the LED when a PWM (Pulse Width Modulation) signal for giving a command of the extinction of the LED is OFF (LOW level), and stopping the supply of the current from the power circuit to the LED when the PWM signal is ON (HIGH level) in response to the PWM signal. See Japanese Patent Document JP-A-2006-86063, particularly pages 3 to 6 and FIG. 1.) According to this method, during the extinction ON operation, a mean current flowing to the LED is reduced and the light emission of the LED is less than that in the a full ON operation. When the current flows to the LED, however, the rated current flows so that a white chromaticity of the LED can be maintained.

To carry out the extinction by approximately 10% in a full ON state by using the DC/DC converter, the ON duty of a switching device provided in the DC/DC converter is not simply reduced, but the switching device is inserted in series with an LED in an output loop of the DC/DC converter, for example, and the ON duty of the switching signal for ON/OFF controlling the switching device is set to be 10%.

If the switching device is inserted in series with the LED in the output loop of the DC/DC converter and the ON-duty of the switching signal for ON/OFF controlling the switching device is set to be 10% so that the ON operation having 10% extinction is carried out, there is a concern that an overshoot might be generated on the current (If) flowing to the LED the moment the switching device transitions from OFF to ON. It also is possible that the LED may not function because a capacitor having a large capacitance is provided on the output side of the DC/DC converter.

Specifically, when the output of the DC/DC converter has no load, that is, the switching device connected in series to the LED transitions from ON to OFF, an output voltage of the DC/DC converter is raised rapidly. When the capacitor having a large capacitance is used on the output side of the DC/DC converter, a large amount of charge is applied to the LED. Thus, an overshoot current flowing to the LED is increased when the switching device connected in series to the LED transitions from ON to OFF and is then turned ON again.

Operation of the DC/DC converter can be stopped while the switching device is OFF to reduce the overshoot current flowing to the LED. However, there is a concern that the output voltage of the DC/DC converter might be reduced during the stop operation of the DC/DC converter and that the current might not flow to the LED with the reduction in the output voltage of the DC/DC converter when the switching device transitions from OFF to ON.

When switching devices are connected in parallel with some or all of the LEDs connected in series, any of the switching devices connected in parallel with any of the LEDs as a light out target is turned ON to bypass current flowing from the DC/DC converter through the switching device, thereby turning OFF the LED and turning OFF the switching device connected in parallel with the LED to serve as the light out target. The current thus flows from the DC/DC converter to the LED, thereby turning ON the LED. A load of the DC/DC converter fluctuates significantly every time the number of the LEDs to serves as the light out target is changed. Furthermore, operation of the DC/DC converter cannot be stopped as long as the LED to serve as the light out target is present. Moreover, the load fluctuates with respect to the DC/DC converter. As discussed above with respect to the former circuit structure, therefore, an overshoot current is generated when the switching device transitions from ON to OFF and is then turned ON again.

In view of the foregoing circuit structures, it is possible to propose reducing ON speeds of the switching device connected in series with the LED and the switching device connected in parallel with the LED. That is, a transient ON state gradually increases the current flowing to the LED when the overshoot current is to be suppressed. However, a period for which a sufficient current does not flow to the LED is generated when the switching device is turned ON/OFF in an ON duty of 10% in order to reduce the ON speed of the switching device, for example, and the actual amount of light is reduced to 5%, for example, even if the ON operation with extinction of 10% is to be carried out. As a result, there is a concern that a linear relationship between the ON duty and the amount of light of the extinction might not be maintained.

SUMMARY

The present disclosure addresses inhibiting an overshoot current from flowing to a semiconductor light source and maintaining a linear relationship between a duty for defining extinction and a quantity of light of the extinction.

To address the foregoing problems, a first aspect is directed to a light emitting apparatus with a DC/DC converter for chopping and transforming an output of a DC power supply, converting a voltage obtained by the transformation into a DC power and supplying the DC power to a load. The apparatus includes at least one semiconductor light source as the load of the DC/DC converter in an output loop of the DC/DC converter, and a current limiting circuit for comparing a signal corresponding to a first input switching signal with a signal corresponding to current flowing to the semiconductor light source, and for opening/closing the output loop in accordance with a result of the comparison, and for causing current to flow to the semiconductor light source so as not to exceed a maximum current while the output loop is closed. A current defined with an ON duty of the first switching signal is caused to flow as a mean current to the semiconductor light source.

When the DC power sent from the output of the DC/DC converter is supplied to the semiconductor light source to control conduction to the semiconductor light source, for example, the signal corresponding to the first switching signal is compared with the signal corresponding to the current flowing to the semiconductor light source to open/close the output loop in the conduction in which the semiconductor light source is subjected to extinction (dimming). Current is caused to flow to the semiconductor light source so as not to exceed a maximum current while the output loop is closed, and current defined with the ON duty of the first switching signal is caused to flow as a mean current to the semiconductor light source. Even if the output loop of the DC/DC converter is opened/closed in accordance with the first switching signal, it is possible to inhibit an overshoot current from flowing to the semiconductor light source and to maintain a linear relationship between an ON duty for defining extinction and a quantity of light of the extinction.

A second aspect is directed to a light emitting apparatus having a DC/DC converter for chopping and transforming an output of a DC power supply, converting a voltage obtained by transformation into a DC power and supplying the DC power to a load. Semiconductor light sources serve as the load of the DC/DC converter in an output loop of the DC/DC converter. The apparatus includes a current limiting circuit for limiting a current of the semiconductor light source, and a switching device group for short-circuiting or opening both ends of at least one of the semiconductor light sources in response to a second input switching signal. A quantity of light of the semiconductor light source is defined with an OFF duty of the second switching signal.

When the DC power from the DC/DC converter is supplied to the semiconductor light source and conduction to the semiconductor light source connected to the switching device set in an open state is controlled, for example, the current of the semiconductor light source is limited by the current limiting circuit and the amount of light of the semiconductor light source is defined with the OFF duty of the second switching signal in the conduction in which the semiconductor light source is subjected to extinction (dimming) in accordance with the second switching signal which is input. Even if the switching device is short-circuited or opened in response to the second switching signal, therefore, it is possible to inhibit an overshoot current from flowing to the semiconductor light source and to maintain a linear relationship between an OFF duty for defining extinction and the amount of light of the extinction.

A third aspect is directed to a light emitting apparatus having a DC/DC converter for chopping and transforming an output of a DC power supply, converting a voltage obtained by the transformation into a DC power and supplying the DC power to a load. The apparatus includes semiconductor light sources as the load of the DC/DC converter in an output loop of the DC/DC converter, a current limiting circuit for comparing a signal corresponding to a first input switching signal with a signal corresponding to a current flowing to the semiconductor light source, for opening/closing the output loop in accordance with a result of the comparison, and for causing a current to flow to the semiconductor light source so as not to exceed a maximum current while the output loop is closed. The apparatus also includes a switching device group for short-circuiting or opening both ends of at least one of the semiconductor light sources in response to a second input switching signal. The amount of light of the semiconductor light source is defined with an ON duty of the first switching signal and an OFF duty of the second switching signal.

When the DC power from the DC/DC converter is supplied to the semiconductor light source and the conduction to the semiconductor light source connected to the switching device set in an open state is controlled, for example, the signal corresponding to the first input switching signal is compared with the signal corresponding to the current flowing to the semiconductor light source to open/close the output loop in the conduction in which the semiconductor light source is subjected to extinction (dimming) in accordance with the first input switching signal or the second input switching signal, a current is caused to flow to the semiconductor light source so as not to exceed a maximum current while the output loop is closed. Furthermore, the amount of light emission of the semiconductor light source is defined with the ON duty of the first switching signal and the OFF duty of the second switching signal. Even if the output loop of the DC/DC converter is opened/closed in accordance with the first switching signal or the switching device is short-circuited or opened in response to the second switching signal, therefore, it is possible to inhibit an overshoot current from flowing to the semiconductor light source and to maintain a linear relationship between the duty for defining extinction and a quantity of light of the extinction.

A fourth aspect is directed to the light emitting apparatus according to the first or third aspect in which the current limiting circuit includes a tripolar semiconductor device in the output loop of the DC/DC converter, a resistor for detecting a current of the semiconductor light source, a signal converter for converting the first switching signal into a signal having a different level in accordance with a logic level thereof and an operational amplifier for comparing a signal obtained by the current detected through the resistor with a signal obtained by the conversion of the signal converter, and for ON/OFF driving the tripolar semiconductor device in accordance with a result of the comparison and controlling an extent of an ON state of the tripolar semiconductor device which is ON.

The current limiting circuit includes the tripolar semiconductor device, the resistor, the signal converter and the operational amplifier. The current of the semiconductor light source is detected by the resistor, the first switching signal is compared with the signal corresponding to the current detected by the resistor through the operational amplifier in response to the first input switching signal, the tripolar semiconductor device is turned ON/OFF in accordance with the result of the comparison, and the extent of the ON state of the tripolar semiconductor device is controlled when it is ON. Therefore, it is possible to share a current limitation and a dimming operation and to simplify the structure of the current limiting circuit.

Some implementations provide one or more of the following advantages. For example, it is possible to inhibit an overshoot current from flowing to the semiconductor light source and to maintain a linear relationship between an ON duty for defining extinction and a quantity of light of the extinction.

Moreover, the vehicle lighting device can perform the dimming and extinction for various brightness of the lighting device (more specifically, by suppressing the overshoot current without generating a change in a chromaticity) corresponding to an operational environment of the vehicle.

It also is possible to simplify the structure of the vehicle lighting device.

Other features and advantages will be readily apparent from the following detailed description, the accompanying drawings, and the claims.

DETAILED DESCRIPTION

Examples according to the invention will be described below with reference to the drawings.

Figure 1:
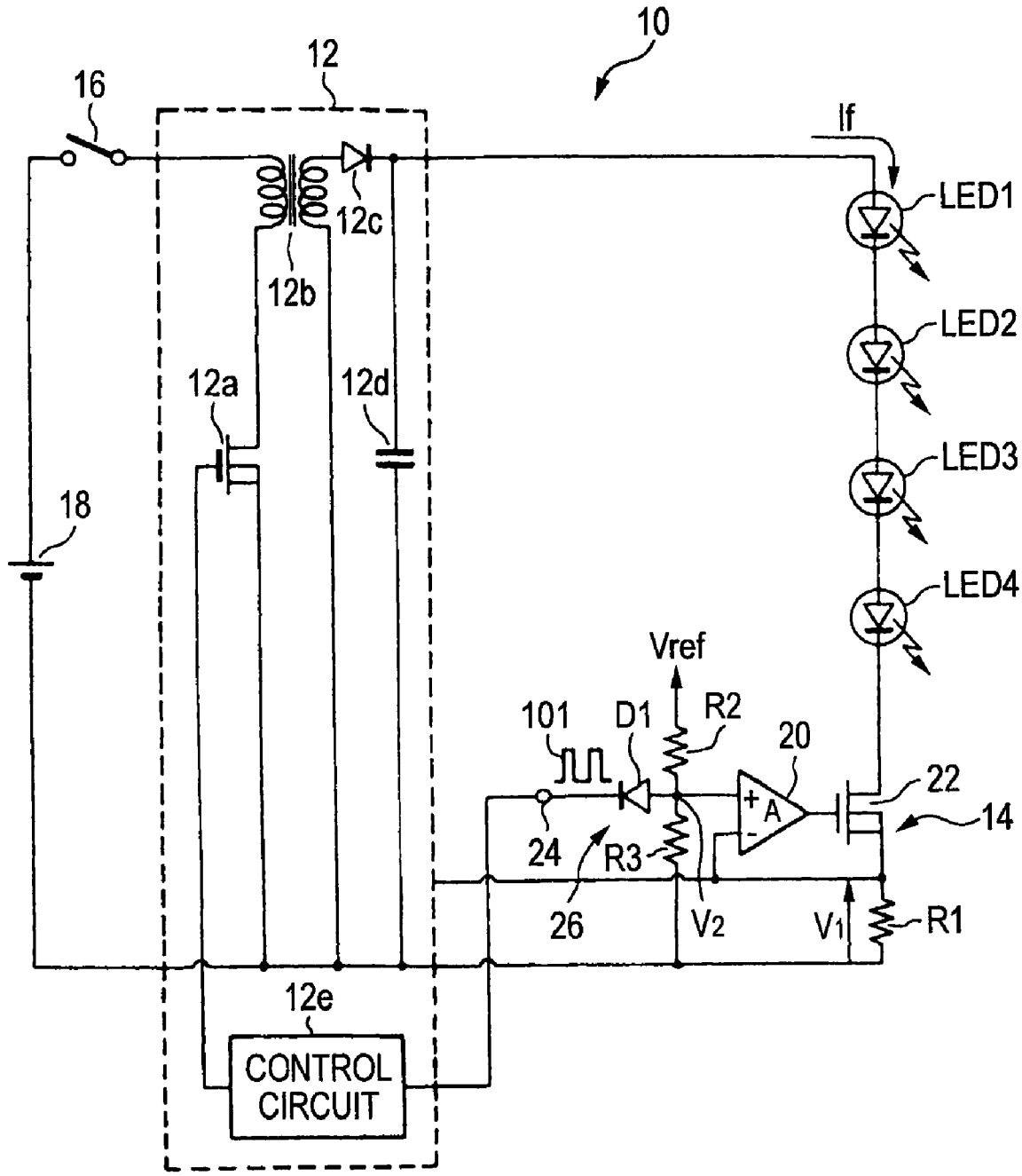
FIG. 1 is a block diagram showing the structure of a light emitting apparatus according to a first example of the invention.

FIG. 1 is a block diagram showing a structure of a light emitting apparatus according to a first example of the invention. In FIG. 1, a light emitting apparatus 10 includes a DC/DC converter 12, a plurality of light emitting diodes LEDs 1 to 4, and a current limiting circuit 14. The DC/DC converter 12 has a switching device (an NMOS or PMOS transistor) 12*a* to be ON/OFF operated in response to a PWM (Pulse Width Modulation) signal, for example, a PWM signal of several hundred Hz to several hundred kHz, a transformer 12*b*, a rectifying device 12*c*, a smoothing capacitor 12*d*, and a control circuit 12*e*. An input side is connected to a battery (DC power supply) 18 through a power switch 16, and the PWM signal sent through an output of the control circuit 12*e* is provided to the switching device 12*a*. The DC/DC converter 12 is implemented as a switching regulator or a switching power supply for chopping a DC voltage applied from the battery 18 through an ON/OFF operation of the switching device 12*a*, raising or dropping the chopped voltage by the transformer 12*b*, rectifying the raised or dropped voltage by the rectifying device 12*c*, and smoothing the voltage by the smoothing capacitor 12*d* and converting the same voltage into a DC power, and supplying, to a load, the DC power obtained by the conversion. Light emitting diodes LEDs 1 to 4 and part of the elements of the current limiting circuit 14 serve as the load of the DC/DC converter 12 in an output loop of the DC/DC converter 12.

The light emitting diodes LEDs 1 to 4 are connected as semiconductor light sources in series to each other in the output loop of the DC/DC converter 12. The number of the light emitting diodes LEDs is not restricted to two or more, but a single LED may be used. A plurality of LEDs connected in series to each other serves as a light source block, and a plurality of light source blocks may be connected in parallel with each other. Moreover, the LEDs 1 to 4 can serve as light sources of various lighting devices for a vehicle, for example, a headlamp, a stop and tail lamp, a fog lamp or a turn signal lamp.

The current limiting circuit 14 is arranged to detect a current flowing to the light emitting diodes LEDs 1 to 4, to compare a signal (e.g., a voltage) corresponding to the detected current with a signal obtained from a first switching signal 101 from the outside (i.e., a voltage corresponding to a logic of the switching signal 101), to open/close an output loop of the DC/DC converter 12 in accordance with a result of the comparison, and to limit the current of the light emitting diodes LEDs 1 to 4 to a specified current while the output loop is closed.

More specifically, the current limiting circuit 14 includes an operational amplifier 20, an NMOS transistor 22, resistors R1, R2 and R3, and a diode D1. The NMOS transistor 22 is located in the output loop of the DC/DC converter 12 together with the resistor R1 and is implemented as a switching device (e.g., a tripolar semiconductor device) for opening/closing the output loop of the DC/DC converter 12 in response to an output voltage of the operational amplifier 20, and has a drain connected to a cathode of the light emitting diode LED 4, a source connected to the resistor R1, and a gate connected to an output terminal of the operational amplifier 20.

The resistor R1 is for detecting a current ("If") flowing to the light emitting diodes LEDs 1 to 4, is connected in series to the NMOS transistor 22, is located in the output loop of the DC/DC converter 12, and serves to detect the current (If) flowing to the LEDs 1 to 4 and to apply a signal corresponding to the detected current as a voltage (a voltage generated on both ends) V1 to a negative input terminal of the operational amplifier 20.

The resistors R2 and R3 are connected to each other in series, with one end side of the resistor R2 connected to a reference voltage Vref and one end side of the resistor R3 grounded. The node of the resistors R2 and R3 is connected to the anode of the diode D1 and a positive input terminal of the operational amplifier 20. The cathode of the diode D1 is connected to a signal input terminal 24. A signal of the control circuit 12*e* or the switching signal 101 from the outside is provided to the signal input terminal 24. The switching signal 101 is generated as a pulse signal having a binary logic level in which a duty (an ON duty) is set to have a specific value. When the switching signal 101 is provided to the signal input terminal 24, the diode D1 is brought into a non-conducting state if the level is HIGH, and a voltage V2 obtained by dividing the reference voltage Vref through the resistors R2 and R3 is applied as a voltage V2*h* (which is higher than 0V) to the positive input terminal of the operational amplifier 20. On the other hand, when the switching signal 101 is provided to the signal input terminal 24, the diode D1 is brought into a conducting state if the level is LOW, and the node of the resistors R2 and R3 is grounded through the diode D1 and the voltage V2 obtained by the division is applied as a voltage of 0V to the positive input terminal of the operational amplifier 20.

More specifically, the resistors R2 and R3 and the diode D1 are implemented as a signal converter 26 for converting the switching signal 101 provided to the signal input terminal 24 into a signal having a different level, for example, the voltage V2*h* or a voltage of 0V in accordance with a logic level thereof The switching signal 101 is not reduced to 0V through a Vf voltage of the diode D1. Therefore, a Schottky diode having low Vf may be used for the diode D1, or a transistor may be used in place of the diode D1. The operational amplifier 20 compares the voltage V1 on both ends of the resistor R1 with the voltage V2*h* applied through the output of the signal converter 26 or a voltage of 0V, and to turn ON/OFF the NMOS transistor 22 in accordance with a result of the comparison. For example, the operational amplifier 20 provides a voltage for setting a difference between the voltage V2*h* and the voltage V1 to be zero and turns ON the NMOS transistor 22 (i.e., brings the MOS transistor 22 into a conducting state) based on the voltage when the voltage V2*h* is applied to the positive input terminal, provides as an output the voltage of 0V, and turns OFF the NMOS transistor 22 (i.e., brings the NMOS transistor 22 into a non-conducting state) based on the voltage of 0V when the voltage of 0V is applied to the positive input terminal.

Figure 2:
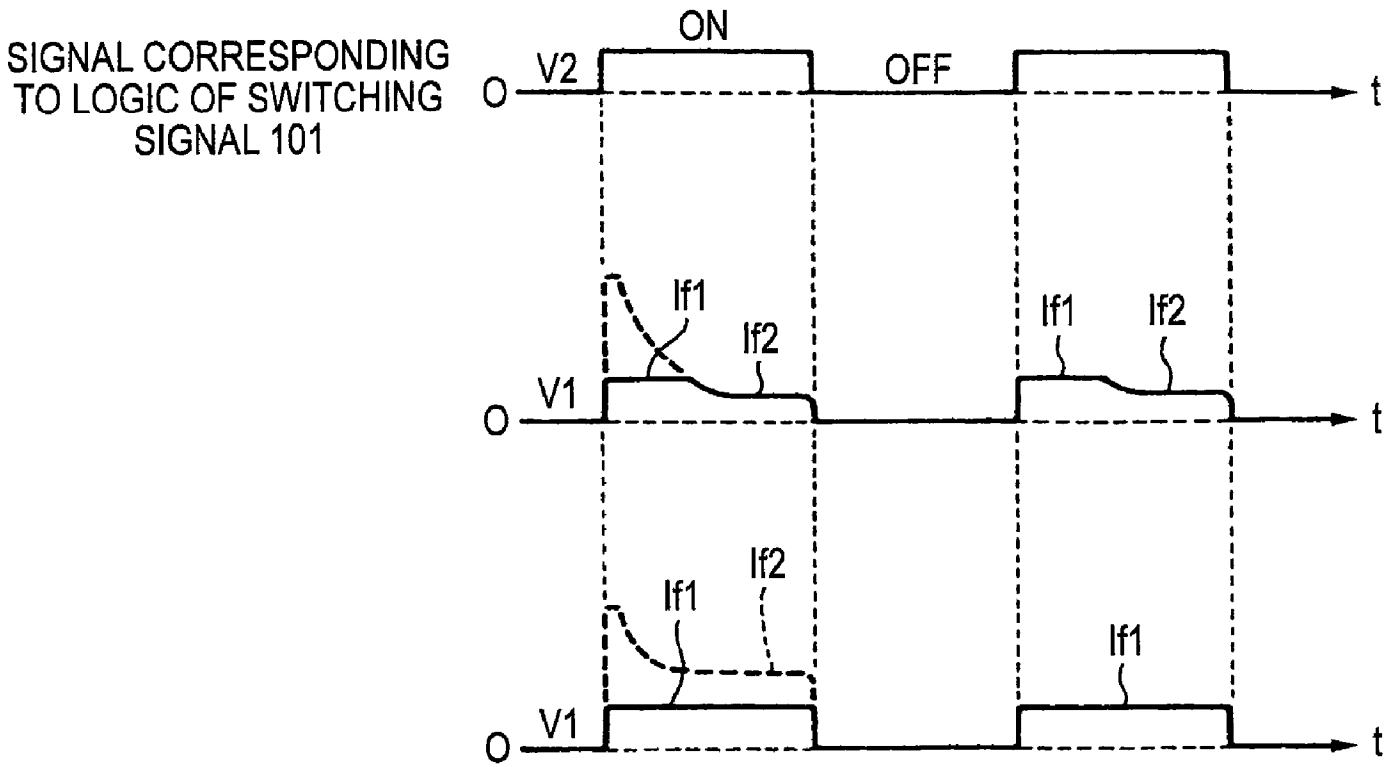
FIG. 2 is a diagram showing the relationship between a signal corresponding to a logic of a first switching signal and a current of a light source.

In this case, when the operational amplifier 20 turns ON/OFF the NMOS transistor 22 in accordance with the switching signal 101, the current flowing to the light emitting diodes LEDs 1 to 4 is limited to be a predetermined current (If1) (for example, a slightly larger current than a rated current of the light emitting diodes LEDs 1 to 4) as shown in FIGS. 2(*b*) and 2(*c*) for an ON operation period as shown in FIG. 2(*a*). For example, FIG. 2(*a*) is a waveform diagram for a signal corresponding to the logic of the first switching signal, FIG. 2(*b*) is a waveform diagram showing a current waveform of a light source which is obtained when a feedback control is executed through a DC/DC converter for the current of the light source, and FIG. 2(*c*) is a waveform diagram showing a current waveform of the light source in the case in which the feedback control is not executed through the DC/DC converter for the current of the light source. More specifically, a current shown in a broken line flows to the light emitting diodes LEDs 1 to 4 when the current limiting circuit 14 is not provided, and the current of the light emitting diodes LEDs 1 to 4 is limited to the current (If1) when the current limiting circuit 14 is provided. When a feedback (FB) control current (set current) 112 obtained by the DC/DC converter 12 is smaller than If1 for the ON operation period of the NMOS transistor 22, If2 flows as the current of the light emitting diodes LEDs 1 to 4 as shown in FIG. 2(*b*).

On the other hand, for the ON operation period of the NMOS transistor 22, when If2 is larger than If1 or the DC/DC converter 12 does not execute the feedback control for the current of the light emitting diodes LEDs 1 to 4, the current If1 limited by the current limiting circuit 14 flows as the current of the light emitting diodes LEDs 1 to 4 as shown in FIG. 2(*c*).

When the ON duty of the switching signal 101 is set to be 100%, the constant current (If) obtained by the feedback control of the DC/DC converter 12 always flows to the light emitting diodes LEDs 1 to 4. When the ON duty of the switching signal 101 is sequentially reduced to be less than 100%, however, a mean current flowing to the light emitting diodes LEDs 1 to 4 is sequentially controlled to have a small value (a mean current defined with the ON duty of the switching signal 101 and the DC/DC converter 12).

For example, when a control configuration is used to control the current If flowing to the light emitting diodes LEDs 1 to 4 to be a constant current and to feed back the voltage on both ends of the resistor R1 to the DC/DC converter 12 to control If to be the constant current in the DC/DC converter 12, the mean current flowing to the light emitting diodes LEDs 1 to 4 (the mean current of If) is set to be a feedback control current If2×0.2 obtained by the feedback control of the DC/DC converter 12 if the ON duty of the switching signal 101 is set to be 20%.

Figure 3:
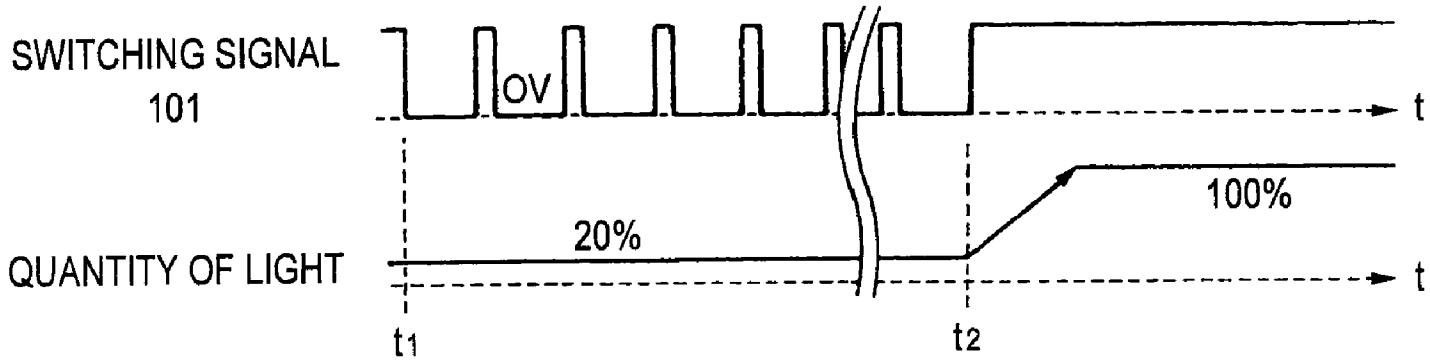
FIG. 3 is a diagram showing the state of each portion according to the first example.

FIGS. 3(*a*) and 3(*b*) show the state of each portion which occurs when the ON duty of the switching signal 101 is changed from 20% to 100%. FIGS. 3(*a*) and 3(*b*) show a state of each portion in which the ON duty of the first switching signal 101 to be applied to the signal input terminal 24 is set to be 20% for only a period from time t1 to time t2 and is set to be 100% after time t2. FIG. 3(*a*) shows a signal waveform of the switching signal 101, and FIG. 3(*b*) shows a property of a visual quantity of light of the whole light emitting diodes LEDs 1 to 4. In this case, the visual quantity of light of the whole LEDs is proportional to the ON duty of the switching signal 101 (that is, proportional to the mean current), and is 20% for the period from time t1 to time t2 and is 100% after the time t2.

According to the illustrated example, the voltage V2 or 0V obtained from the switching signal 101 is compared with the voltage V1 on both ends of the resistor R1 through the operational amplifier 20 to open/close the output loop in a conduction state in which the light emitting diodes LEDs 1 to 4 are subjected to extinction (dimming), the current If of the light emitting diodes LEDs 1 to 4 is limited so as not to exceed the maximum current If1, and the current defined with the ON duty of the switching signal 101 is caused to flow as the mean current to the light emitting diodes LEDs 1 to 4 while the output loop is closed. Even if the output loop of the DC/DC converter 12 is opened/closed in accordance with the switching signal 101, therefore, it is possible to inhibit an overshoot current from flowing to the light emitting diodes LEDs 1 to 4 and to maintain a linear relationship between the ON duty for defining the extinction or dimming and a quantity of light of the extinction.

Next, a second example is described with reference to FIG. 4. In the example, a switching device 28 is connected to both ends of a light emitting diode LED 1, a switching device 30 is connected to both ends of a light emitting diode LED 2, a switching device 32 is connected to both ends of each of light emitting diodes LEDs 3 and 4, the switching devices 28, 30 and 32 are connected to signal input terminals 34, 36 and 38 respectively, the switching devices 28, 30 and 32 are turned ON/OFF in accordance with switching signals (second switching signals) 201, 202 and 203 applied from a control circuit 12*e* to the signal input terminals 34, 36 and 38, and both ends of the light emitting diode LED 1, both ends of the light emitting diode LED 2 and both ends of each of the light emitting diodes LEDs 3 and 4 are short-circuited in light out or are opened in lighting respectively, or the short circuit and the opening are repeatedly alternately dimmed (extinguished) by ON/OFF operation of the switching devices 28, 30 and 32. The other structures are the same as those in the first example.

More specifically, a current If flowing to the light emitting diodes LEDs 1 to 4 is limited by a current limiting circuit 14. The light emitting diodes LEDs 1 to 4 are divided into three groups, that is, a group including the light emitting diode LED 1, a group including the light emitting diode LED 2, and a group including the light emitting diodes LEDs 3 and 4. The lighting, light out and dimming of the light emitting diode LED belonging to each of the groups also can be controlled by the switching signals 201, 202 and 203.

For example, it is possible to turn ON all of the light emitting diodes LEDs 1 to 4 by setting the ON duty of each of the switching signals 201, 202 and 203 to be 0%, and to turn OFF all of the light emitting diodes LEDs 1 to 4 by setting the ON duty of each of the switching signals 201, 202 and 203 to be 100%. Moreover, it is possible to carry out the dimming (extinction) over all of the light emitting diodes LEDs 1 to 4 by setting the OFF duty of each of the switching signals 201, 202 and 203 to have a value which is smaller than 100% and greater than 0%.

Figure 5:
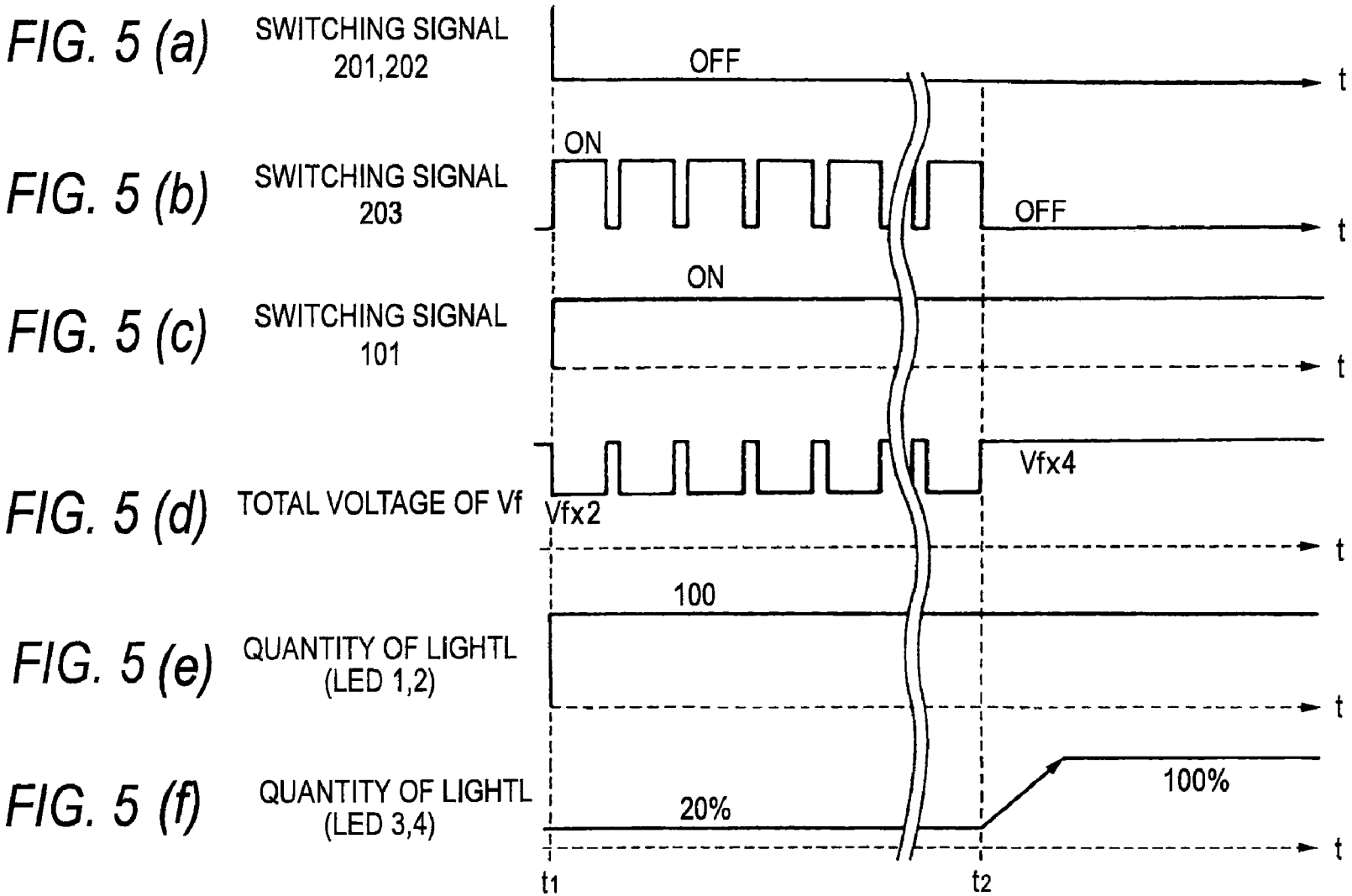
FIG. 5 is a diagram showing the state of each portion according to the second example.

For simplicity of the description, FIGS. 5(*a*) to 5(*f*) show the state of each portion which occurs by changing only the OFF duty of the switching signal 203 from 20% to 100% with the ON duty of a switching signal 101 set to be 100% and the OFF duty of each of the switching signals 201 and 202 set to be 100%. FIGS. 5(*a*) to 5(*f*) show the state of each portion which occurs when the OFF duty of the switching signal 203 to be applied to the signal input terminal 38 is set to be 20% for only a period from time t1 to time t2 and the same OFF duty is set to be 0% after time t2. FIG. 5(*a*) shows a waveform of the switching signals 201 and 202, FIG. 5(*b*) shows a waveform of the switching signal 203, FIG. 5(*c*) shows a waveform of the switching signal 101, FIG. 5(*d*) shows a waveform of a total voltage of a forward voltage Vf to be applied to both ends of each of the light emitting diodes LEDs 1 to 4, FIG. 5(*e*) shows a property of a visual light quantity of each of the light emitting diodes LEDs 1 and 2, and FIG. 5(*f*) shows a property of a visual light quantity of each of the 2-serial light emitting diodes LEDs 3 and 4. In this case, the visual light quantities of the two LEDs are proportional to the OFF duty of the switching signal 203, and are 20% for the period from time t1 to time t2 and are 100% after time t2.

In the illustrated example, when conduction to an optional one of the light emitting diodes LEDs 1 to 4 is to be controlled based on the switching signals 201 to 203 (for example, in a process for setting the OFF duty of any of the switching signals 201 to 203 to control the light emitting diode to be an extinction (dimming) target so as to have a value for specifying the extinction (dimming) and ON/OFF controlling the switching device connected to the light emitting diode to be the extinction (dimming) target (any of the switching devices 28, 30 and 32) in accordance with the switching signal (any of the switching signals 201 to 203) in the conduction in which an optional one of the light emitting diodes LEDs 1 to 4 is subjected to the extinction (dimming)), a voltage obtained from the switching signal 101 is represented by V2*h*, and the voltage V2*h* is compared with a voltage V1 on both ends of a resistor R1 through an operational amplifier 20 and the driving operation of an NMOS transistor 22 is turned ON/OFF in accordance with a result of the comparison. Furthermore, the extent of the ON state of the NMOS transistor 22 which is ON is controlled and the current If of the light emitting diodes LEDs 1 to 4 is limited. More specifically, when the NMOS transistor 22 is turned ON, the ON resistance of the NMOS transistor 22 is regulated so that the NMOS transistor 22 absorbs (generates) heat, as a resistance, a voltage (energy=$\frac{1}{2}\cdot CV^2$) applied from a capacitor 12*d* and corresponding to an overshoot current flowing to the light emitting diodes LEDs 1 to 4.

According to the example, therefore, even if the switching signal 101 is turned ON by 100% and any of the switching devices 28, 30 and 32 is ON/OFF controlled in accordance with any of the switching signals 201 to 203, the current flowing to the light emitting diodes LEDs 1 to 4 is limited so that it is possible to prevent the overshoot current from flowing to the light emitting diodes LEDs 1 to 4 and to maintain a linear relationship between the OFF duty for defining the extinction and the quantity of light of the extinction.

Figure 4:
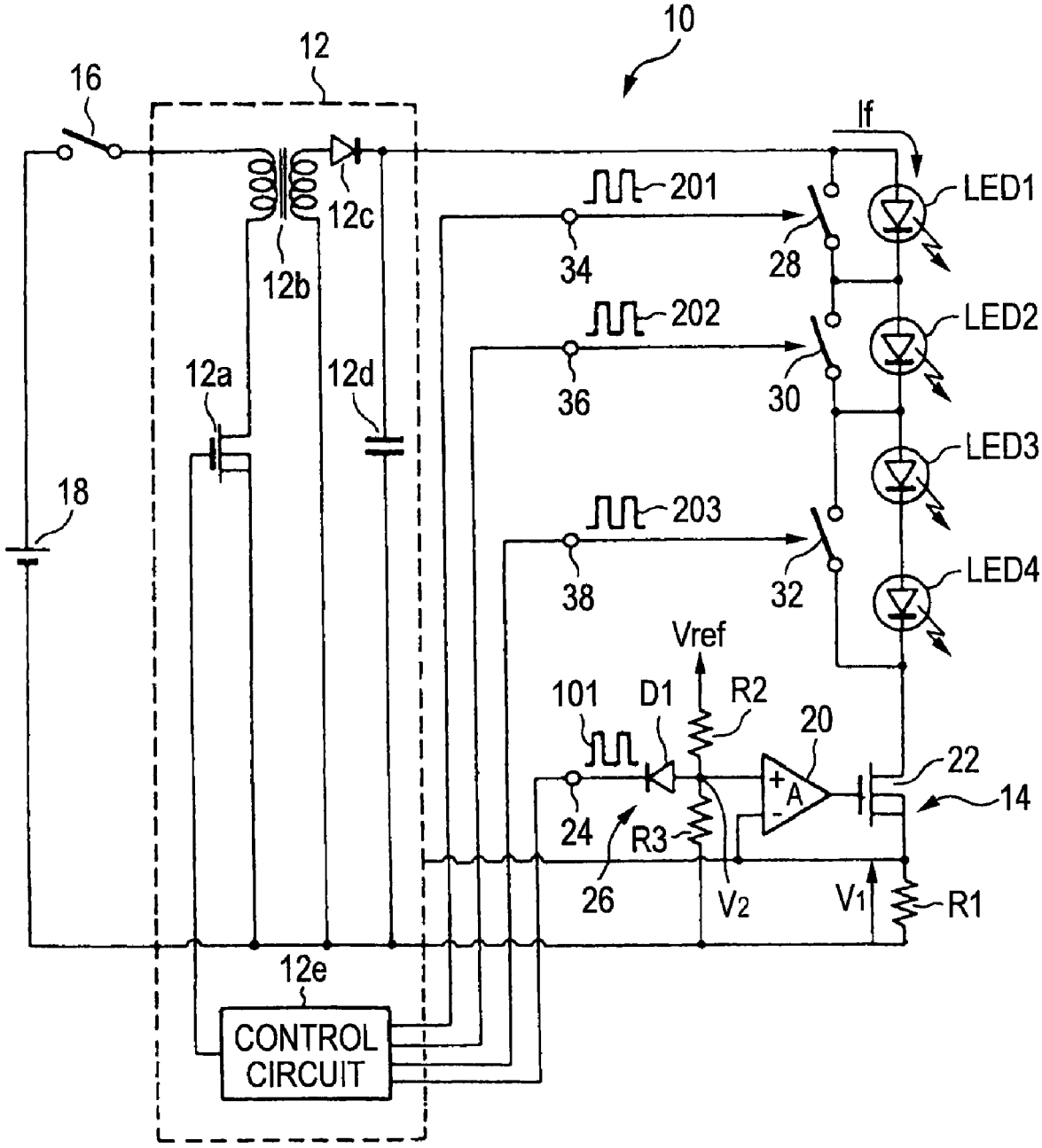
FIG. 4 is a block diagram showing the structure of a light emitting apparatus according to a second example of the invention.

At this time, even if the switching signal 101 is not present (for example, if the diode D1 in FIG. 4 is removed or the signal input terminal 24 is opened), it is possible to obtain a circuit operation which is equivalent to the operation for setting the switching signal 101 to have the ON duty of 100%.

According to the example, it is possible to perform the dimming or extinction over the light emitting diodes LEDs 1 to 4 by turning OFF (i.e., ON duty of 0%) all of the switching signals 201 to 203 and setting the ON duty of the switching signal 101 to have a value for specifying the dimming (extinction) operation of the light emitting diodes LEDs 1 to 4. By setting the ON duty of the switching signal (the first switching signal) 101 and the OFF duty of each of the switching signals (the second switching signals) 201 to 203 to have the value for specifying the dimming (extinction) operation of the light emitting diodes LEDs 1 to 4, it is possible to perform the dimming or extinction over the light emitting diodes LEDs 1 to 4.

Moreover, it is possible to control an optional one of the LEDs based on an optional brightness (a quantity of light of the extinction) by controlling the ON/OFF operation of the first switching signal 101 and the second switching signals 201 to 203 in a predetermined timing.

For example, by setting the switching signal 101 to have an ON duty of 50% in a shorter cycle than an ON/OFF cycle of the switching signal 203 for the period from time t1 to time t2 in FIG. 5, it is possible to set the quantities of light of the light emitting diodes LEDs 1 and 2 to be approximately 50% and to set the quantities of light of the light emitting diodes LEDs 3 and 4 to be approximately 10%.

By setting the switching signal 101 to have an ON duty of 50% in a longer cycle than the ON/OFF cycle of the switching signal 203, alternatively, it is also possible to set the quantities of light of the light emitting diodes LEDs 1 and 2 to be approximately 50% and to set the quantities of light of the light emitting diodes LEDs 3 and 4 to be approximately 10%.

In each of the examples, moreover, the current limiting circuit 14 is implemented by the NMOS transistor 22, the resistor R1, the signal converter 26 and the operational amplifier 20. The current of the light emitting diodes LEDs 1 to 4 is detected by the resistor R1, the switching signal 101 is converted into a voltage corresponding to a logic thereof through the signal converter 26 in response to the switching signal 101, the voltage obtained by the conversion is compared with the voltage on both ends of the resistor R1 through the operational amplifier 20, the NMOS transistor 22 is turned ON/OFF in accordance with the result of the comparison, and the extent of the ON state of the NMOS transistor 22 which is ON is controlled. Consequently, it is possible to share the current limitation and the extinction operation, thereby simplifying the structure of the current limiting circuit 14.

In each of the examples, moreover, it is possible to employ a control configuration for feedback controlling the current (If) in the DC/DC converter 12 or a control configuration for carrying out such a feedback control as to simply output a voltage which is equal to or higher than a total of Vf (Vf of the whole light emitting diodes LEDs 1 to 4).

In the latter case, the constant current control of current (If) and the limitation of current (If) are mainly executed by the operational amplifier 20 and the NMOS transistor 22. The DC/DC converter 12 carries out control for providing a voltage which is sufficient for the supply of the current. If the ON duty of the switching signal 101 is set to be 20%, the mean current flowing to the light emitting diodes LEDs 1 to 4 (the mean current of If) is expressed in the current If1×0.2 (see FIG. 2(*c*)).

According to each of the examples, moreover, it is possible to implement a lighting device for a vehicle which can suitably carry out the dimming or extinction over the brightness of the lighting device (can suppress the overshoot current without generating a change in a chromaticity) corresponding to the operating environment of the vehicle.

Figure 6:
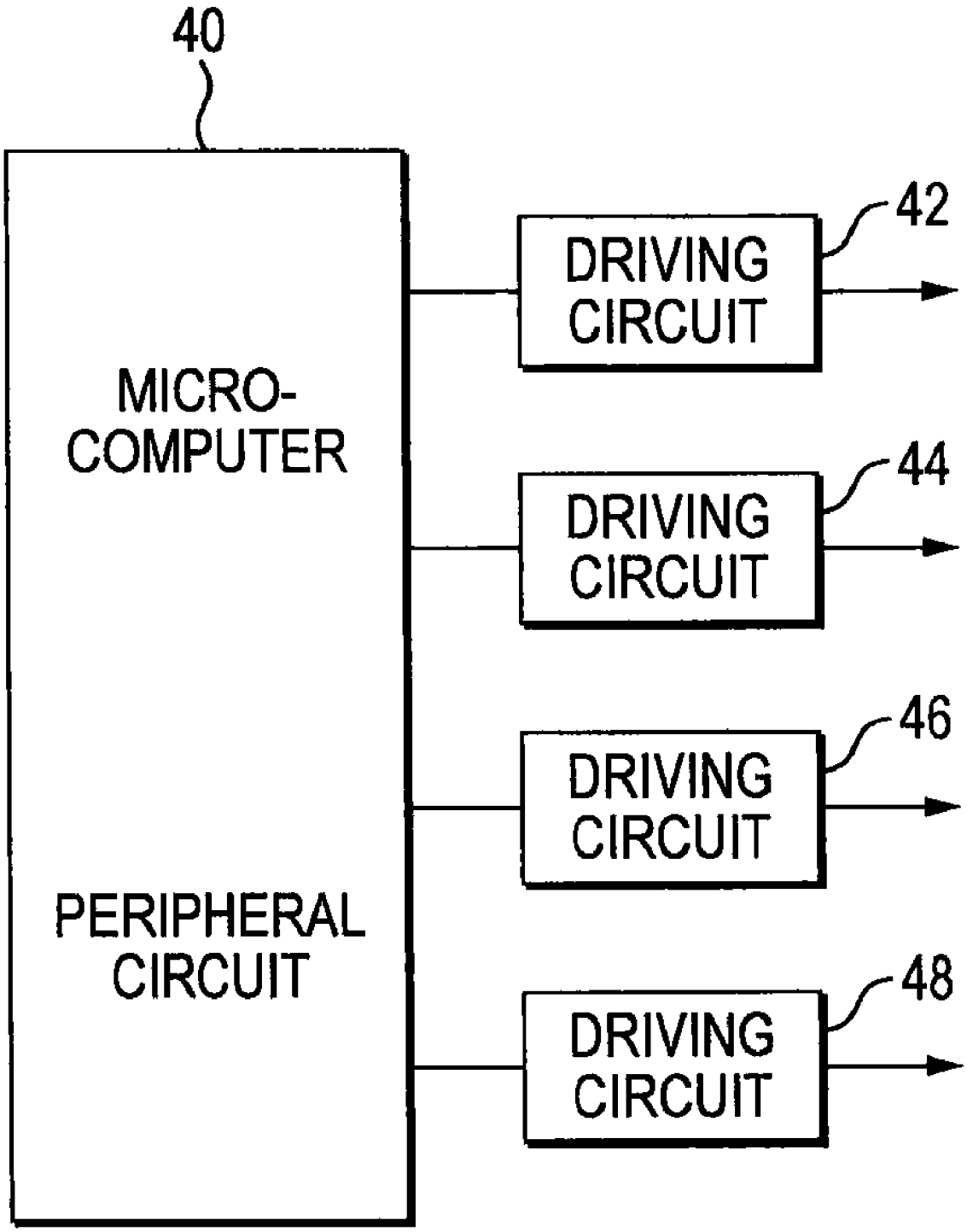
FIG. 6 is a block diagram showing structures of a signal generating circuit and a driving circuit.

On the other hand, when the lighting or dimming of the light emitting diodes LEDs 1 to 4 is to be controlled based on the switching signal 101 and the switching signals 201 to 203, the switching signal 101 and the switching signals 201 to 203 can be generated by a control circuit provided in the DC/DC converter 12. In addition, it is possible to employ a structure in which the switching signal 101 and the switching signals 201 to 203 are generated in accordance with a program through a signal generating circuit 40 including a microcomputer (a microprocessor) and a peripheral circuit thereof and the switching signal 101 thus generated is amplified by a driving circuit 42 and is then applied to the signal input terminal 24, and furthermore, the switching signals 201 to 203 thus generated are amplified by driving circuits 44, 46 and 48 respectively and are thereafter applied to the signal input terminals 34, 36 and 38 as shown in FIG. 6 or a structure in which a switching signal in signals to be used in an on-vehicle electronic apparatus which corresponds to the switching signal 101 or the switching signals 201 to 203 is applied to the signal input terminal 24 and the signal input terminals 34, 36 and 38.

Other implementations are within the scope of the claims.

What is claimed is:

1. A light emitting apparatus comprising:

a DC/DC converter to chop, in response to a chopping signal that controls an on/off operation, and transform an output of a DC power supply, to convert a voltage obtained by the transformation into a DC power, and to supply the DC power to a load, at least one semiconductor light source as the load of the DC/DC converter in an output loop of the DC/DC converter, and a current limiting circuit to compare a signal corresponding to a first switching signal with a signal corresponding to a current flowing to the at least one semiconductor light source, to open/close the output loop in accordance with a result of the comparison, and to cause a current to flow to the at least one semiconductor light source so as not to exceed a maximum current while the output loop is closed, wherein the current limiting circuit comprises a resistor connected in series with the at least one semiconductor light source to detect the current flowing to the at least one semiconductor light source, the signal corresponding to a current flowing to the at least one semiconductor light source comprises a voltage across the resistor, and the DC/DC converter is connected to the resistor to receive the voltage across the resistor as a feedback signal, and wherein the apparatus is arranged so that a current defined with an ON duty of the first switching signal is caused to flow as a mean current to the semiconductor light source.

2. The light emitting apparatus according to claim 1, wherein the current limiting circuit includes:

a tripolar semiconductor device in the output loop of the DC/DC converter, a signal converter to convert the first switching signal into a signal having a different level in accordance with a logic level thereof, and an operational amplifier to compare a signal obtained by the current detected through the resistor with a signal obtained by the conversion of the signal converter, wherein the current limiting circuit is arranged to perform ON/OFF driving of the tripolar semiconductor device in accordance with a result of the comparison and to control an extent of an ON state of the tripolar semiconductor device which is ON.

3. A vehicle lighting device comprising the light emitting apparatus according to claim 1.

4. A light emitting apparatus comprising:

a DC/DC converter to chop, in response to a chopping signal that controls an on/off operation, and transform an output of a DC power supply, convert a voltage obtained by the transformation into a DC power and supply the DC power to a load, a plurality of semiconductor light sources as the load of the DC/DC converter in an output loop of the DC/DC converter, a current limiting circuit to limit a current of the semiconductor light sources and to inhibit flow of an overshoot current to the semiconductor light sources, wherein the current limiting circuit comprises a resistor connected in series with the plurality of semiconductor light sources, a voltage across the resistor corresponds to the current of the semiconductor light source, and the DC/DC converter is connected to the resistor to receive the voltage across the resistor as a feedback signal, and a switching device group comprising a plurality of switching devices to short-circuit or open both ends of at least one of the semiconductor light sources in response to switching signals, wherein the amount of light of the semiconductor light source is defined with an OFF duty of the switching signals.

5. A vehicle lighting device comprising the light emitting apparatus according to claim 4.

6. A light emitting apparatus comprising:

a DC/DC converter to chop, in response to a chopping signal that controls an on/off operation, and transform an output of a DC power supply, convert a voltage obtained by the transformation into a DC power and supply the DC power to a load, a plurality of semiconductor light sources as the load of the DC/DC converter in an output loop of the DC/DC converter, a current limiting circuit to compare a signal corresponding to a first switching signal with a signal corresponding to a current flowing to the semiconductor light sources, to open/close the output loop in accordance with a result of the comparison, and to cause a current to flow to the semiconductor light sources so as not to exceed a maximum current while the output loop is closed, wherein the current limiting circuit comprises a resistor connected in series with the plurality of semiconductor light sources to detect the current flowing to the semiconductor light sources, the signal corresponding to a current flowing to the semiconductor light sources comprises a voltage across the resistor, and the DC/DC converter is connected to the resistor to receive the voltage across the resistor as a feedback signal, and a switching device group to short-circuit or open both ends of at least one of the semiconductor light sources in response to second switching signals, wherein the amount of light of the semiconductor light sources is defined with an ON duty of the first switching signal and an OFF duty of the second switching signal.

7. The light emitting apparatus according to claim 6, wherein the current limiting circuit includes:

a tripolar semiconductor device in the output loop of the DC/DC converter, a signal converter to convert the first switching signal into a signal having a different level in accordance with a logic level thereof, and an operational amplifier to compare a signal obtained by the current detected through the resistor with a signal obtained by the conversion of the signal converter, wherein the current limiting circuit is arranged to perform ON/OFF driving of the tripolar semiconductor device in accordance with a result of the comparison and to control an extent of an ON state of the tripolar semiconductor device which is ON.

8. A vehicle lighting device comprising the light emitting apparatus according to claim 6.

* * * * *